United States Patent [19]

Eda et al.

[11] 4,141,643

[45] Feb. 27, 1979

[54] DEVELOPING ELECTRODE ARRANGEMENT FOR ELECTROPHOTOGRAPHIC APPARATUS

[75] Inventors: Tadahiro Eda; Nobuo Mochizuki; Yukihiko Nakagawa, all of Tokyo, Japan

[73] Assignee: Ricoh Company, Ltd., Tokyo, Japan

[21] Appl. No.: 788,952

[22] Filed: Apr. 19, 1977

Related U.S. Application Data

[63] Continuation of Ser. No. 602,052, Aug. 5, 1975, abandoned.

[30] Foreign Application Priority Data

Sep. 13, 1974 [JP] Japan ..... 49/106275

[51] Int. Cl.[2] ..... G03G 15/00; G03G 15/10

[52] U.S. Cl. ..... 355/3 DD; 118/648; 355/10

[58] Field of Search ..... 355/3 R, 3 DD, 14, 10; 118/647, 648

[56] References Cited

U.S. PATENT DOCUMENTS

| | | | |
|---|---|---|---|
| 3,611,982 | 10/1971 | Coriale | 118/648 X |
| 3,707,943 | 1/1973 | Matsumoto et al. | 355/10 |
| 3,782,818 | 1/1974 | Smith | 355/10 |
| 3,892,481 | 7/1975 | Schaefer et al. | 355/14 |
| 3,908,037 | 9/1975 | Bickmore | 355/3 DD |

*Primary Examiner*—R. L. Moses

*Attorney, Agent, or Firm*—Frank J. Jordan

[57] ABSTRACT

A photoconductive drum or sheet is movable relative to a developing electrode which is biased to a voltage which prevents smearing of the background areas of the copy. A sensing electrode is disposed upstream of the developing electrode in the direction of movement of the drum or sheet which senses the voltage on the drum or sheet. The sensing electrode is provided in a plurality of independent segments, and a computing circuit selects the voltage on the segment which is lowest in magnitude and which corresponds to a background area of the copy and applies the biasing voltage to the developing electrode in dependence on the sensed voltage. An auxiliary electrode is provided so that the combination of the sensing electrode and the auxiliary electrode is coextensive with the drum or sheet in a direction perpendicular to the movement thereof to prevent streaking of the copy. The auxiliary electrode is either electrically floated and thereby self-biased by the drum or sheet or the biasing voltage from the computing circuit is applied thereto.

22 Claims, 7 Drawing Figures

DEVELOPING ELECTRODE ARRANGEMENT FOR ELECTROPHOTOGRAPHIC APPARATUS

This is a continuation of application Ser. No. 602,052, filed Aug. 5, 1975 now abandoned.

The present invention relates to a developing electrode arrangement for an electrophotographic apparatus.

In known electrophotographic copying apparatus employing either a wet or dry powered developing or toner substance, it is comon to provide a developing electrode adjacent to a photoconductive member such as a drum or sheet. The developing electrode is biased to a voltage which is slightly higher than that of the image background areas on the photoconductive member so that toner particles are attracted to the developing electrode rather than to the background areas of the photoconductive member. This prevents smearing of the background areas of the copies.

However, especially with photoconductive members formed of organic semiconductors, it is common for the voltage or potential of the background areas of the photoconductive member to vary within a range of about 100 to 230 volts due to aging of the photoconductive member (in the case of a drum of belt), contamination of the imaging optical system, temperature of the developing substance and the like. For this reason, a system has been proposed in which a sensing electrode is provided upstream of the developing electrode to sense the potential of the background areas of the photoconductive member and computing means responsive to the output of the sensing electrode to apply the biasing voltage to the developing electrode as a function of the sensed voltage. A plurality of sensing electrodes may be provided, with the computing means operative to select the output of the sensing electrode which has the lowest voltage.

A problem exists in this system in that gaps are provided between the sensing electrodes along the width of the photoconductive member. Especially if the input impedance of the computing circuit is high, an electrostatic potential is induced on the sensing electrodes by the adjacent photoconductive member. The sensing electrodes thereby act as auxiliary developing electrodes. Specifically, streaks are formed on the copy sheets in such a manner that the areas corresponding to the positions of the sensing electrodes are lighter than the areas corresonding to positions where the sensing electrodes are not provided.

It is therefore an object of the present invention to eliminate streaks in copies produced by an electrophotographic apparatus of the type described above.

It is another object of the present invention to provide an electrophotographic apparatus comprising sensing electrodes and an auxiliary electrode adjacent to the sensing electrodes in such a manner that the combination of the sensing electrodes and auxiliary electrode is coextensive with the width of the photoconductive member thereby eliminating streaks in the copies produced by the apparatus.

The above and other objects, features and advantages of the present invention will become clear from the following detailed description taken with the accompanying drawings, in which.

Figure 1:
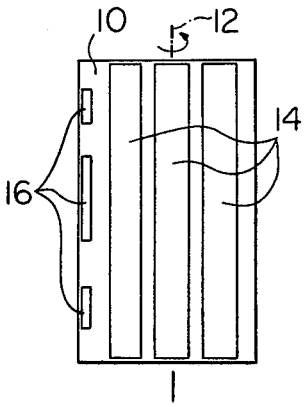
Fig. 1 PRIOR ART
FIG. 1 is a fragmentary schematic view of a prior art electrophotographic apparatus comprising developing electrodes and sensing electrodes.

Referring now to FIG. 1 which illustrates the problem of the prior art which the present invention is designed to solve, a photoconductive drum 10 is rotatable about an axis 12 as shown by an arrow. Three developing electrodes 14 are disposed adjacent to the drum 10 so that the drum 10 is rotatable relative thereto. In addition, three sensing electrodes 16 are disposed adjacent to the drum 10 upstream of the developing electrodes 14 in the direction of movement of the drum 10. The sensing electrodes 16 sense the voltage on the adjacent areas of the drum 10. A computing circuit which will be described in detail below selects the lowest voltage sensed by the sensing electrodes 16 which corresponds to the voltage of the background areas of the electrostatic image on the drum 10 and applies a biasing voltage to the developing electrodes 14 in dependence thereon. It will be noted that spaces are provided between the sensing electrodes 16 which produce the streaks discussed above.

Figure 2:
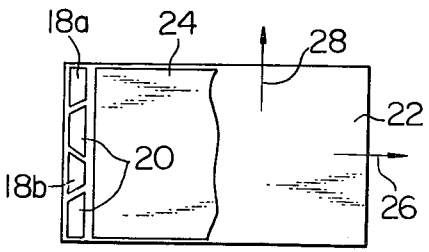
FIG. 2 is similar to FIG. 1 but shows an embodiment of the present invention.

Referring now to FIG. 2, the present invention proposes to provide sensing electrodes **18*a* and 18*b* and auxiliary electrodes 20 relative to a photoconductive sheet 22 as shown. The photoconductive sheet 22 is movable in the direction shown by an arrow 26 adjacent to a developing electrode 24. The sensing electrodes 18*a* and 18*b* and the auxiliary electrodes 20 are also arranged adjacent to the sheet 22 upstream of the developing electrode 24 in the direction of the arrow 26. The sensing electrodes 18*a* and 18*b* and the auxiliary electrodes 20 are arranged in the direction of an arrow 28 which is perpendicular to the arrow 26 and therefore perpendicular to the direction of movement of the sheet 22. Furthermore, the sensing electrodes 18*a* and 18*b* and the auxiliary electrodes 20 are triangular in shape so as to overlap in the direction of the arrow 28. The auxiliary electrodes 20 may either electrically float so as to be self-biased to the same approximate voltages as the sensing electrodes 18*a* and 18*b* by the sheet 22 or may be biased to the same voltage as the developing electrode 24 by the computing circuit as will be described in detail below. The auxiliary electrodes 20 are provided to fill any spaces between the sensing electrodes 18*a* and 18*b* so that the combination of the sensing electrodes 18*a* and 18*b* and the auxiliary electrodes 20 is substantially coextensive with the sheet 22 in the direction of the arrow 28 (the width of the sheet 22). Since approximately the same voltages are induced in the electrodes 18*a* and 18*b* and 20, the sheet 22 will be exposed to a uniform voltage along its width (in the direction of the arrow 28) and thereby the streaks inherently produced by the arrangement shown in FIG. 1** are eliminated.

Figure 3:
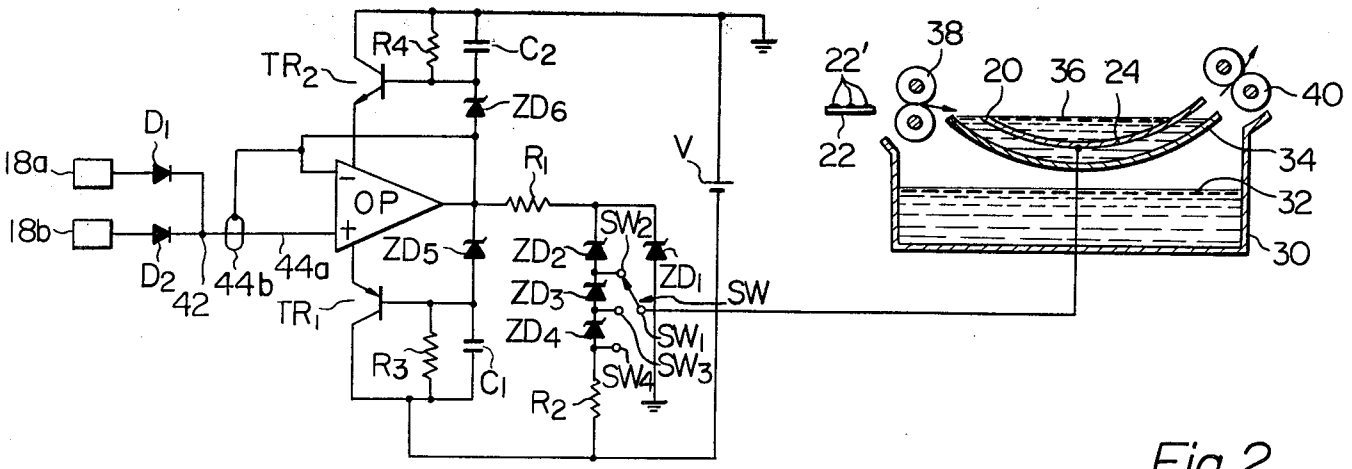
FIG. 3 is a schematic view showing other important parts of the electrophotographic apparatus shown in FIG. 2.

FIG. 3 shows the electrophotographic apparatus in greater detail. A charging unit which is not shown is provided to apply a negative electrostatic charge to the sheet 22, which is provided with a layer of a photoconductive material. The sheet 22 is then exposed to a light image of an original document by an optical imaging unit which is similarly not shown so that the charge on the sheet 22 is dissipated in such a manner as to form an electrostatic or latent image. This is represented in FIG. 3 in the form of dark areas 22' on the sheet 22, with the areas between the dark areas 22', representing background areas of the image. A developing unit to develop the elctrostatic image and provide a visible or toner image is shown and comprises a tank 30 which is filled with a liquid developer up to a level 32. A developing tray 34 and the developing electrode 24 are provided above the tank 30. A pump which is not shown is provided to pump liquid developer from the tank 30 into the tray 34 up to a level 36 so that liquid developer fills the space between the top of the tray 34 and the bottom of the developing electrode 24. Feed rollers 38 are disposed at the entrance (left side) or the developing tray 34 and feed rollers 40 are provided at the exit (right side) thereof to feed the sheet 22 through the liquid developer in the space between the tray 34 and developing electrode 24. The developing liquid contains toner particles which adhers to the areas 22' of the sheet 22 which have a voltage higher than the bias potential or voltage on the developing electrode 24. The feed rollers 40 feed the sheet 22 to a fixing and drying unit (not shown) which fixes the toner image onto the sheet 22 and drys the same.

The computing circuit for applying the biasing voltage to the developing electrode 24 and to the auxiliary electrodes 20 if desired is also shown in FIG. 3. The sensing electrodes 18*a* and 18*b* are connected to the anodes of diodes D1 and D2 respectively, the cathodes of which are connected to a junction 42. The junction 42 is connected to a non-inverting input of an operational amplifier OP. The output of the operational amplifier OP is grounded through the series combination of a resistor R1 and a zener diode ZD1, with the anode of the zener diode ZD1 grounded. The junction between the resistor R1 and the zener diode ZD1 is connected to the negative terminal of a battery V through zener diodes ZD2, ZD3 and ZD4 and a resistor R2. The positive terminal of the battery V is grounded. The resistor R2 is connected to the negative terminal of the battery and the anodes of the zener diodes ZD2, ZD3 and ZD4 face the negative terminal of the battery V.

A switch SW has a movable contact SW1 connected to the developing electrode 24 and fixed contact SW2 connected to the junction of the zener diodes ZD2 and ZD3. The switch SW further has fixed contacts SW3 and SW4 connected to the junction between the zener diodes ZD3 and ZD4 and the junction between the zener diodes ZD4 and the resistor R2 respectively.

The output of the operational amplifier OP is also connected to the cathode of a zener diode ZD5, the anode of which is connected to the negative terminal of the battery V through the parallel combination of a resistor R3 and a capacitor C1. The anode of the zener diode ZD5 is also connected to the base of a PNP transistor TR1, the emitter of which is connected to a positive supply terminal of the operational amplifier OP and the collector of which is connected to the negative terminal of the battery V. The output of the operational amplifier OP is further connected to the anode of a zener diode ZD6, the cathode of which is grounded through the parallel combination of a resistor R4 and a capacitor C2. The cathode of the zener diode ZD6 is also connected to the base of an NPN transistor TR2, the emitter of which is connected to a negative power supply terminal of the operational amplifier and the collector of which is connected to ground. The zener diodes ZD5 and ZD6, transistors TR1 and TR2, resistors R3 and R4 and the capacitors C1 and C2 serve as a voltage regulating means to apply regulated supply voltages to the operational amplifier OP.

The junction 42 is connected to the non-inverting input of the operational amplifier OP through a line 44*a* which is provided with shielding 44*b*. The shielding 44*b* is connected to the output of the operational amplifier OP and also to an inverting input thereof. The purpose of the shielding 44*b* is to prevent the accumulation of toner particles on the sensing electrodes 18*a* and 18*b* which might be caused by the capacitance between the sensing electrodes 18*a* and 18*b* and ground, the input capacitance of the operational amplifier OP, the capacitance and leakage current of the shielding 44*b* and similar effects. The DC potential of the shielding 44*b* is therefore equal to the output of the operational amplifier OP and the shielding 44*b* is AC grounded.

In operation, assuming the sheet 22 is negatively charged by the charging unit (not shown), the outputs of the sensing electrodes 18*a* and 18*b* are applied to the diodes D1 and D2 so that the voltage at the junction 42 is equal to the output of the sensing electrode 18*a* or 18*b* which has the lowest voltage. This corresponds to the voltage of the background areas of the sheet 22. It will be noted that the number of sensing electrodes and associated diodes may be any number greater than two if desired, and the operation will be the same in that the voltage at the junction 42 will be equal to the output of the sensing electrode which has the lowest voltage at the junction 42 is applied to the input of the operational amplifier OP through the line 44*a*.

The operational amplifier OP is adapted to produce a voltage output which is a predetermined function of the input thereof which depends on the amount of electrostatic induction between the sheet 22 and the sensing electrodes 18*a* and 18*b*, the electrical resistivity of the developing liquid and other relevant variables. The voltages at the contacts SW2, SW3 and SW4 of the switch SW will thereby vary in accordance with the output voltage of the operational amplifier OP with the switch contact SW4 having the largest negative voltage, the switch contact SW2 having the smallest negative voltage and the switch contact SW3 having a negative voltage intermediate between those of the switch contacts SW4 and SW2. The movable contact SW1 of the switch SW is manually movable by the apparatus operator to select the desired one of these voltages. The purpose of the switch SW is to compensate for such copying variables as colored paper (other than white), copies of originals which have no true background areas, copies of low contrast originals and the like. If desired, the switch SW and the zener diodes ZD2, ZD3 and ZD4 may be omitted and the junction of the resistors R1 and R2 connected directly to the developing electrode 24. It will be understood that the lowest voltage sensed by the sensing electrodes 18*a* and 18*b* depends on the condition of the sheet 22, the imaging system (not shown), the temperature of the developing liquid (the voltage of the sheet 22 is sensed through the developing liquid) and similar factors and the biasing voltage applied to the developing electrode 24 is therefore dependent thereon. It will be similarly understood that the sensing electrodes 18*a* and 18*b* may be considered as an integral unit with the electrodes 18*a* and 18*b* themselves considered as segments which are electrically insulated from each other.

Figure 4:
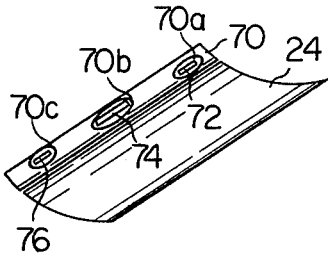
FIG. 4 shows a modification of the embodiment shown in FIG. 2.

A modification of the sensing electrodes and auxiliary electrode is shown in FIG. 4, in which an auxiliary electrode 70 is provided which is substantially coextensive with the width of the sheet 22. The auxiliary electrode 70 is formed with holed or cutouts 70*a*, 70*b* and 70*c* in which are disposed sensing electrodes 72, 74 and 76. The sensing electrodes 72, 74 and 76 are electrically insulated from each other and from the auxiliary electrode 70.

Figure 5:
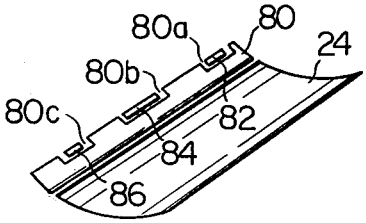
FIG. 5 shows another modification of the embodiment shown in FIG. 2.

Another modification is shown in FIG. 5, in which an auxiliary electrode 80 similar to the auxiliary electrode 70 is provided with notches 80*a*, 80*b* and 80*c* in which are disposed sensing electrodes 82, 84 and 86. The sensing electrodes 82, 84 and 86 are electrically insulated from each other and from the auxiliary electrode 80. The auxiliary electrodes 70 and 80 may either electrically float and be self-biased by the sheet 22 or be connected to the contact SW1 of the switch SW along with the developing electrode 24.

Figure 6:
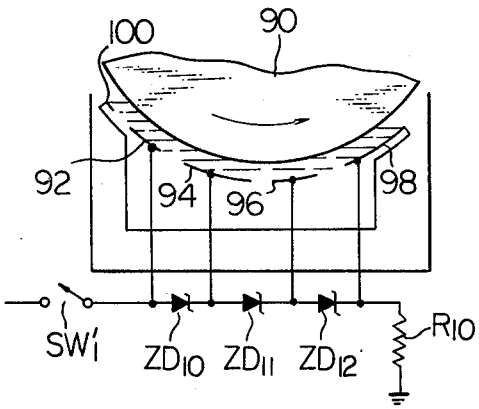
FIG. 6 shows another embodiment of the present invention.

Referring now to FIG. 6, it will be seen that the present invention is also applicable to an electrophotographic apparatus in which the photoconductive member is a drum 90. Developing electrodes 92, 94, 96 and 98 are provided below the drum 90, which is rotatable counterclockwise, and the space between the developing electrodes and the drum is filled with liquid developer. A movable contact SW1′ similar to the movable contact SW1 is connected through zener diodes ZD10, ZD11 and ZD12 and a resistor R10 to ground, with the cathodes of the zener diodes facing ground. The developing electrode 92 is connected to the movable contact SW1′. The developing electrode 94 is connected to the junction of the zener diodes ZD10 and ZD11. The developing electrode 96 is connected to the junction of the zener diodes ZD11 and ZD12 and the developing electrode 98 is connected to the junction of the zener diode ZD12 and the resistor R10. An auxiliary electrode 100 such as one of the auxiliary electrodes 70 or 80 is also shown which is connected to the developing electrode 98. Sensing electrodes are not visible in FIG. 6. The effect of the zener diodes ZD10, ZD11 and ZD12 is to provide a voltage reduction or gradient on the developing electrodes so that the voltage on the developing electrode 92 is the highest and the voltage on the developing electrode 98 and thereby on the auxiliary electrode 100 is lowest. In FIG. 6, the developing electrodes 92, 94, 96 and 98 may be replaced by a single developing electrode and the zener diodes ZD10, ZD11 and ZD12 omitted if desired. The connection between the developing electrode 98 and the auxiliary electrode 100 may also be omitted and the auxiliary electrode 100 allowed to electrically float.

Figure 7:
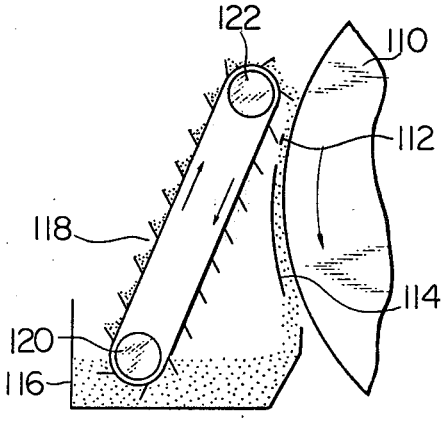
FIG. 7 shows an embodiment of the present invention adapted to a cascade development system.

As shown in FIG. 7, the invention is also adaptable to an electrophotographic apparatus utilizing a photoconductive drum 110 and powdered toner. The drum 110 is rotatable counterclockwise adjacent to an auxiliary electrode 112 and a developing electrode 114. Sensing electrodes are not visible in the FIG. 7. The powdered toner is disposed in a tank 116 and a coveyor belt 118 trained over rollers 120 and 122 conveys the powdered toner from the tank 116 onto the surface of the drum 110 above the auxiliary electrode 112. This is known as a cascade development system and is widely used in the art. It will be noted that the toner powder is disposed between the auxiliary and developing electrodes 112 and 114 and the drum 110 and thereby the sensing electrodes (not shown) sense the voltage on the drum 110 through the toner powder.

From the above detailed description, it will be clearly understood that the present invention is adaptable to any electrophotographic apparatus which comprises a developing electrode and one or more sensing electrodes, no matter whether the photoconductive member is in drum or similar form (such as an endless belt) to transfer the toner image to a copy sheet or the photoconductive member is in the form of a photoconductive sheet which is directly imaged. It is also immaterial as to whether the toner is in liquid or powdered form. Many other modifications to the present invention will be possible to those skilled in the art after receiving the teachings of the present disclosure.

What is claimed is:

1. An electrophotographic apparatus comprising, in combination:

a developing electrode;

a photoconductive member movable relative and adjacent to the developing electrode;

a sensing electrode disposed upstream of the developing electrode in a direction of movement of the photoconductive member for sensing a voltage on the photoconductive member;

computing means responsive to the voltage sensed by the sensing electrode and operative to apply a biasing voltage to the developing electrode in dependence thereon; and operable means operable with said sensing electrodes to expose the photoconductive member with substantially uniform voltage across the width of the photoconductive member to thereby eliminate streaking, said operable means comprising an auxiliary electrode disposed upstream of the developing electrode in a direction of movement of the photoconductive member, said auxiliary electrode being disposed in alignment with the sensing electrode in such a manner that the combination of the sensing electrode and the auxiliary electrode lie in the same transverse line extending transversely across the width of the photoconductive member in a direction generally perpendicular to the direction of movement of the photoconductive member.

2. The appratus of claim 1, in which the auxiliary electrode electrically floats and is self-biased by the photoconductive member.

3. The appratus of claim 1, in which the computing means is further operative to apply the biasing voltage to the auxiliary electrode.

4. The apparatus of claim 1, in which the auxiliary electrode is formed with a cutout, the sensing electrode being disposed in the cutout and electrically insulated from the auxiliary electrode.

5. The apparatus of claim 1, in which the auxiliary electrode is formed with a notch, the sensing electrode being disposed in the notch and being electrically insulated from the auxiliary electrode.

6. The apparatus of claim 1, in which the sensing electrode comprises a plurality of segments which are electrically insulated from each other, the computing means being connected to the segments in such a manner as to apply the biasing voltage to the developing electrode in dependence on a lowest voltage sensed by the segments.

7. The apparatus of claim 1, in which the combination of the sensing electrode and the auxiliary electrode is substantially coextensive with the photoconductive member in the direction perpendicular to the direction of movement of the photoconductive member.

8. The apparatus of claim 1, in which a developing substance is provided between the sensing electrode and the photoconductive member, the sensing electrode being operative to sense the voltage on the photoconductive member through the developing susbstance.

9. The apparatus of claim 8, in which the developing substance is a liquid.

10. The apparatus of claim 8, in which the developing substance is a powder.

11. The apparatus of claim 8, in which the developing substance is provided between the developing electrode and the photoconductive member.

12. The apparatus of claim 1, in which the photoconductive member is a sheet.

13. The apparatus of claim 1, in which the photoconductive member is a drum.

14. The apparatus of claim 1, in which the computing means comprises an operational amplifier.

15. The apparatus of claim 1, in which the computing means comprises control means for controllably reducing the magnitude of the biasing voltage.

16. The apparatus of claim 15, in which the control means comprises a plurality of zener diodes connected in series and a switch having contacts connected to the junctions of the zener diodes.

17. The apparatus of claim 1, in which teh developing electrode is formed in a plurality of segments which are electrically insulated from each other.

18. The apparatus of claim 17, in which the computing means is adapted to apply different biasing volages to the respective segments of the developing electrode.

19. An electrophotographic apparatus comprising, in combination;

a developing electrode;

a photoconductive member movable relative and adjacent to the developing electrode;

sensing electrode means disposed upstream of the developing electrode in a direction of movement of the photoconductive member for sensing a voltage on the photoconductive member, said sensing electrode means being disposed along a transverse line extending transversely across the width of the photoconductive member and extending perpendicular to the direction of movement of the photoconductive member, said sensing electrode means having at least one gap disposed along said transverse line;

computing means responsive to the voltage sensed by the sensing electrode and operative to apply a biasing voltage to the developing electrode in dependence thereon; and operable means operable with said sensing electrode means to expose the photoconductive member with substantially uniform voltage across the width of the photoconductive member to thereby eliminate streaking, said operable means comprising auxiliary electrode means which electrically floats and is self-biased by the photoconductive member, said auxiliary electrode means being disposed in said gap in such a manner that the combination of the sensing electrode means and the auxiliary electrode means lie in said transverse line, whereby substantially a uniform voltage is applied to said sensing electrode means and said auxiliary electrode means thereby exposing said photoconductive member to a uniform voltage along its width.

20. An electrophotographic apparatus comprising, in combination;

a developing electrode;

a photoconductive member movable relative and adjacent to the developing electrode;

sensing electrode means disposed upstream of the developing electrode in a direction of movement of the photoconductive member for sensing a voltage on the photoconductive member, said sensing electrode means being disposed along a transverse line extending transversely across the width of the photoconductive member and extending perpendicular to the direction of movement of the photoconductive member, said sensing electrode means having at least one gap disposed along said transverse line;

computing means responsive to the voltage sensed by the sensing electrode and operative to apply a biasing voltage to the developing electrode in dependence thereon; and operable means operable with said sensing electrode means to expose the photoconductive member with substantially uniform voltage across the width of the photoconductive member to thereby eliminate streaking, said operable means comprising auxiliary electrode means, said computing means being further operative to apply the biasing voltage to the auxiliary electrode means, said auxiliary electrode means being disposed in said gap in such a manner that the combination of the sensing electrode means and the auxiliary electrode means lie in said transverse line, whereby substantially a uniform voltage is applied to said sensing electrode means and said auxiliary electrode means thereby exposing said photoconductive member to a uniform voltage along its width.

21. An electrophotographic apparatus comprising, in combination;

a devleoping electrode;

a photoconductive member movable relative and adjacent to the developing electrode;

sensing electrode means disposed upstream of the developing electrode in a direction of movement of the photoconductive member for sensing a voltage on the photoconductive member, said sensing electrode means extending transversely across the width of the photoconductive member, said sensing electrode means having at least one gap along said transverse width;

computing means responsive to the voltage sensed by the sensing electrode and operative to apply a biasing voltage to the developing electrode in dependence thereon; and auxiliary electrode means which electrically floats and is self-biased by the photoconductive member, said auxiliary electrode means being disposed in said gap and operable in conjunction with said sensing electrode means to preclude streaking by exposing said photoconductive member to substantially uniform voltage across its transverse width.

22. An electrophotographic apparatus comprising, in combination;

a developing electrode;

a photoconductive member movable relative and adjacent to the developing electrode;

sensing electrode means disposed upstream of the developing electrode in a direction of movement of the photoconductive member for sensing a voltage on the photoconductive member, said sensing electrode means extending transversely across the width of the photoconductive member, said sensing electrode means having at least one gap along said transverse width;

computing means responsive to the voltage sensed by the sensing electrode and operative to apply a biasing voltage to the developing electrode in dependence thereon; and auxiliary electrode means disposed in said gap, said computing means being further operative to apply the biasing voltage to the auxiliary electrode means, said auxiliary electrode means being operable in conjunction with said sensing electrode means to preclude streaking by exposing said photoconductive member to substantially uniform voltage across its transverse width.

* * * * *